US006046120A

United States Patent [19]

Rodrigues

[11] Patent Number: 6,046,120

[45] Date of Patent: Apr. 4, 2000

[54] HYDROPHILIC FINISH FOR TEXTILES

[75] Inventor: Klein A. Rodrigues, Signal Mountain, Tenn.

[73] Assignee: National Starch and Chemical Investment Holding Corporation, Wilmington, Del.

[21] Appl. No.: 09/047,054

[22] Filed: Mar. 24, 1998

[51] Int. Cl.[7] ..... D03D 3/00

[52] U.S. Cl. ..... 442/173; 442/118; 442/119; 442/152; 442/164; 442/167; 442/168; 525/207; 525/285; 525/327.4; 525/384; 525/404

[58] Field of Search ..... 525/207, 285, 525/327.4, 384, 404; 442/118, 119, 164, 167, 168, 173, 152

[56] References Cited

U.S. PATENT DOCUMENTS 4,191,799 3/1980 Gruber ..... 428/96

4,985,298 1/1991 Buckley et al. ..... 428/288

*Primary Examiner*—Helen L. Pezzuto
*Attorney, Agent, or Firm*—John D. Thallemer

[57] ABSTRACT

An improved textile material having a hydrophilic finish which is made by a method comprising applying to a fibrous web an aqueous solution comprising an anhydride based graft copolymer, and drying the fibrous web at a temperature sufficient to cure the anhydride based graft copolymer in the fibrous web. The anhydride based graft copolymer is the reaction product of an ethylenically unsaturated monomer, an anhydride monomer selected from maleic anhydride and itaconic anhydride, either a monofunctional polyglycol having a hydroxyl or amine terminal group or a polyfunctional polyglycol having a weight average molecular weight of greater than 5,000 and at least one terminal hydroxyl group, and a free radical initiator. The hydrophilic finish eliminates the shortcomings inherent in certain textile materials such as their high affinity for oils, staining during washing, static cling problems, and wearer discomfort.

7 Claims, No Drawings

HYDROPHILIC FINISH FOR TEXTILES

FIELD OF THE INVENTION

This invention relates to a method for applying a hydrophilic finish to textile materials, especially polyester or blends of polyester with other textile materials.

BACKGROUND OF THE INVENTION

Textiles prepared from polyester retain creases, resist wrinkles, and are durable. However, polyester has the following inherent properties which are in need of improvement. Polyester is hydrophobic and thus is uncomfortable to the wearer especially in warm temperatures. Since oils have a relatively high affinity for polyester compared to, for example, cotton, many food stains, oils, and body oils permanently stain polyester. Because of its natural affinity for oils or oil borne stains, polyester actually collects soil during laundering, and thus fabrics containing polyester tend to grey or yellow after a few washes. Additionally, because polyester has a very low moisture regain, it tends to exhibit static cling problems. Therefore, it would be advantageous to provide a hydrophilic finish to polyester.

SUMMARY OF THE INVENTION

Accordingly it is an object of the present invention to provide a method which eliminates or at least reduces the shortcomings of polyester by providing a durable hydrophilic finish to polyester.

It is also an object of the invention to provide a hydrophilic finish to textile materials which enhances the detergency properties of the textile materials thereby providing improved cleaning of the textile material.

With regard to the foregoing and other objects, the present invention provides an improved textile material having a hydrophilic finish which is made by a method comprising (I) applying to a fibrous web an aqueous solution comprising an anhydride based graft copolymer, wherein said anhydride based graft copolymer comprises the reaction product of an ethylenically unsaturated monomer, an anhydride monomer selected from the group consisting of maleic anhydride, itaconic anhydride, and mixtures thereof, either a monofunctional polyglycol having a hydroxyl or amine terminal group or a polyfunctional polyglycol having a weight average molecular weight of greater than 5,000 and at least one terminal hydroxyl group, and a free radical initiator; and (II) drying the fibrous web at a temperature sufficient to cure the anhydride based graft copolymer in the fibrous web, wherein the concentration of anhydride based graft copolymer in the solution is sufficient to provide 0.1 to 20 weight percent of the anhydride based graft copolymer in the web based on the dry weight of the textile material prepared from the web.

According to another aspect the invention provides a method for applying a hydrophilic finish to textile materials comprising applying an anhydride based graft copolymer to a textile material, wherein said anhydride based graft copolymer is prepared by a two-step process comprising reacting an ethylenically unsaturated monomer and an anhydride monomer selected from the group consisting of maleic anhydride, itaconic anhydride, and mixtures thereof, and a free radical initiator, in the presence of a solvent, and isolating the product from the solvent and reacting the product with either a monofunctional polyglycol having a hydroxyl or amine terminal group or a polyfunctional polyglycol having a weight average molecular weight of greater than 5,000 and at least one terminal hydroxyl group, to form an anhydride based graft copolymer, wherein said anhydride based graft copolymer is added in an amount effective to provide said hydrophilic finish.

The anhydride based graft copolymers of the invention provide a durable hydrophilic finish to textile materials, preferably textile materials prepared from polyester and blends of polyester. Such hydrophilic finish eliminates the shortcomings inherent in polyester such as polyester's natural affinity for oils and oil borne stains, polyester's tendency to collect soil during laundering, static cling problems inherent in polyester, and wearer discomfort resulting from the hydrophobicity of polyester.

DESCRIPTION OF THE INVENTION

This invention provides a method for treating a fibrous web to improve the hydrophilic finish of the textile material prepared therefrom. In general, the method involves applying an aqueous solution comprising an anhydride based graft copolymer to the web such that the resulting textile material, having been dried, exhibits significantly improved hydrophilic properties. Suitable textiles are, for example, polyester, cotton, polyacrylics, polyamides, polyolefins, rayons, and wool. Preferably, the textile is polyester or a blends of polyester with at least one of the following: cotton, polyacrylics, polyamides, polyolefins, rayons, and wool.

The anhydride based graft copolymer is prepared either by a one-step or a two-step process. In the one-step process, the anhydride based graft copolymer is prepared by reacting an ethylenically unsaturated monomer, an anhydride monomer selected from the group consisting of maleic anhydride, itaconic anhydride, and mixtures thereof, a monofunctional polyglycol having a hydroxyl or amine terminal group, in the presence of a free radical initiator in a polymerization reactor. No solvent is used in the one-step process. In one embodiment of a one-step process, the anhydride based graft copolymers involves heating a mixture containing the monomers, polyglycol, and free radical initiator to cause the monomers to polymerize, and then heating the polymer at a higher temperature in the presence of polyglycol for a sufficient period of time to form the anhydride based graft copolymer. A solventless method for preparing anhydride based graft copolymers is described in U.S. patent application Ser. No. 09/047,032, entitled, "In Situ Solvent Free Method For Making Anhydride Based Graft Copolymers", filed Mar. 24, 1998, now abandoned which is hereby incorporated by reference in its entirety.

In the two-step process, the anhydride based graft copolymer is prepared by reacting an ethylenically unsaturated monomer and an anhydride monomer selected from the group consisting of maleic anhydride, itaconic anhydride, and mixtures thereof, in the presence of a solvent and a free radical initiator, to prepare a copolymer which is reacted with a monofunctional polyglycol having a hydroxyl or amine terminal group. In one embodiment of a two-step process, the anhydride based graft copolymers are prepared by solution polymerization in the presence of aromatic hydrocarbon solvents or ketone solvents. In a preferred process, the anhydride based graft copolymers are prepared by solution polymerization using incremental feed addition of the monomers and catalyst into a reactor containing an aromatic hydrocarbon or ketone solvent. The polymerization is conducted at the reflux temperature of the monomers and solvent mixture. The copolymer is isolated and reacted with polyethylene glycol to form the anhydride based graft copolymer.

The ethylenically unsaturated monomer is selected from vinyl esters, alpha-olefins, alkyl esters of acrylic and methacrylic acid, substituted or unsubstituted mono and dialkyl esters of unsaturated dicarboxylic acids, vinyl aromatics, unsubstituted or substituted acrylamides, cyclic monomers, monomers containing alkoxylated side chains, sulfonated monomers, and vinyl amide monomers. A combination of ethylenically unsaturated monomers may also be used.

Suitable vinyl esters are, for example, vinyl acetate, vinyl formate, vinyl propionate, vinyl butyrate, vinyl isobutyrate, vinyl valerate, vinyl 2-ethyl-exanoate, vinyl isooctanoate, vinyl nonoate, vinyl decanoate, vinyl pivalate, and vinyl versatate. Suitable alkyl esters of acrylic and methacrylic acid are, for example, methyl acrylate, methyl methacrylate, ethyl acrylate, ethyl methacrylate, propyl acrylate, butyl acrylate, pentyl acrylate, hexyl acrylate, and 2-ethyl hexyl acrylate, etc. Suitable substituted or unsubstituted mono and dialkyl esters of unsaturated dicarboxylic acids are, for example, substituted and unsubstituted mono and dibutyl, mono and diethyl maleate esters as well as the corresponding fumarates. Suitable vinyl aromatic monomers preferably contain from 8 to 20 carbon atoms, most preferably from 8 to 14 carbon atoms. Examples of vinyl aromatic monomers are styrene, 1-vinyl napthalene, 2-vinyl napthalene, 3-methyl styrene, 4-propyl styrene, t-butyl styrene, 4-cyclohexyl styrene, 4-dodecyl styrene, 2-ethyl-4-benzyl styrene, 4-(phenylbutyl) styrene, 3-isopropenyl-$\alpha$, $\alpha$-dimethylbenzyl isocyanate, and halogenated styrenes.

Suitable acrylamide based monomers are, for example, acrylamide, N, N-dimethylacrylamide, N-octyl acrylamide, N-methylol acrylamide, dimethylaminoethylacrylate, etc. Suitable cyclic monomers are, for example, vinyl pyrrolidone, vinyl imidazolidone, vinyl pyridine, etc. Suitable sulfonated monomers are, for example, 2-acrylamido-2-methyl propane sulfonic acid, sodium methallyl sufonate, sodium vinyl sulfonate, sulfonated sytrene, etc.

Suitable vinyl amide monomers are, for example, N-vinyl formamide, N-vinyl acetamide, etc.

The anhydride monomer contains ethylenically unsaturation. Combinations of anhydride monomers may also be used in the invention. Preferably the anhydride monomer is selected from maleic anhydride or itaconic anhydride.

The polyglycol is preferably a monofunctional polyglycol having a terminal hydroxyl or amine group. Polyfunctional polyglycols having two or more terminal functional groups may be used in the method of the invention provided that such polyfunctional polyglycols have a weight average molecular weight of greater than 5,000 and at least one of the terminal function groups is a hydroxyl group.

Preferably, the polyglycol is a condensation product of an alkyl oxide having 2 to 20 carbon atoms, preferably 2 to 6 carbon atoms. Suitable alkyl oxides are, for example, ethylene oxide, propylene oxide, butylene oxide, hexylene oxide, etc. The polyglycol can also be an alcohol ethoxylate wherein the alcohol is a linear or branched alkyl alcohol having 1 to 20 carbon atoms. Examples of such alcohols are hexanol, dodecanol, decanol etc. The alcohol can also be an aryl alcohol such as phenol or an alkylaryl alcohol such as nonyl phenol. Preferably the polyglycol is selected from a monofunctional polyethylene glycol having from about 6 to about 20 ethylene glycol repeating units, or a $C_5$–$C_{20}$ alcohol ethoxylate having from 6 to 10 moles of ethoxylation. Mixtures of polyglycols may also be used in the method of the invention.

In a preferred embodiment of the invention, the polyglycol has the formula $R^1$—$(CH_2CHR^3O)_m$—$R^2$ wherein $R^1$ is OH or $NH_2CHR^3CH_2$, $R^2$ is selected from an alkyl group having $C_1$–$C_4$ or phenol, m is from about 2 to about 20, and $R^3$ is independently H, methyl, ethyl, propyl, or phenyl.

In a second preferred embodiment of the invention, the polyglycol has he formula $R^1$—$(CH_2CHR^3O)_m$—$(CH_2)_n$—H wherein $R^1$ is OH or $NH_2$ $CHR^3CH_2$, m is from about 2 to about 20, and n is from about 5 to about 20. More preferably, m is from about 5 to about 10 and n is from about 12 to about 15.

The free radical initiator can be any initiator which is capable of generating free radicals. Some representative examples of free radical initiators which may be used to prepare the polymers of the invention are the various persulfates, percarbonates, perborates, peroxides, azo compounds, and perketals. Such free radical initiators are known to those skilled in the art.

The choice of free radical initiator and amount employed will depend on the reactivity of the initiator. Preferably, the free radical initiator is present in an amount of from about 0.01 to about 10 weight percent, preferably from about 0.1 to about 2 weight percent, based on the total weight of monomers in the polymerization reactor. It is noted that using too much of a very reactive initiator in the polymerization reaction may cause excessive grafting which may result in crosslinking between side chains and the formation of an insoluble gel which is undesirable.

The anhydride based graft copolymer may be formulated with such additives as are commonly incorporated into textiles. Such additives include flame retardants, fillers, pigments, dyes, softeners, post-added surfactants and catalysts, and crosslinking agents. A combination of additives may also be used.

Any method of applying the anhydride based graft copolymer to the fibrous web is acceptable provided the web is impregnated with the anhydride based graft copolymer. As used herein "impregnate" refers to the penetration of the anhydride based graft copolymer into the fiber matrix of the web, and to the distribution of the anhydride based graft copolymer in a preferably substantially uniform manner into and through the interstices in the web. The anhydride based graft copolymer preferably envelopes, surrounds, and/or impregnates individual fibers substantially through the thickness of the web as opposed to only forming a surface coating on the web.

The anhydride based graft copolymer is advantageously applied to the fibrous web in a textilemaking process prior to final drying. The treated textile is dried at the normal temperatures provided by a drying unit on a textilemaking machine, preferably a steam heated drying cylinder. Drying temperatures generally range from about 50° C. to about 120° C. The residence time of the fibrous web or textile material in the dryer unit ranges from about 5 seconds to about 200 seconds, depending on the temperature. Generally, a residence time of about at least 30 seconds is required for lower temperatures of about 50° C. while less than about 10 seconds is required for higher temperatures of about 120° C. After the web or textile material with the anhydride based graft copolymer applied thereto is dried/cured, subsequent coatings or additives may be applied.

Optionally, a catalyst may be added to the anhydride based graft copolymer to promote reaction between the anhydride based graft copolymer and the fibrous web, but it is a feature of the invention that no catalyst is generally required. Suitable catalysts include salts of polyvalent cations such as aluminum chloride and aluminum sulfate. A combination of catalysts may also be used.

Preferred means of applying the anhydride based graft copolymer to the web or textile material are by puddle press, size press, blade coater, speedsizer, spray applicator, curtain coater rod, gravure roll, air-knife, and water box. The anhydride based graft copolymer may also be sprayed directly onto the web or textile material or onto rollers which transfer the anhydride based graft copolymer to the web or textile material. In one embodiment of the invention, impregnation of the web or textile material with the anhydride based graft copolymer occurs at the nip point between two rollers. In another embodiment of the invention, the saturation of the web or textile material occurs by passing the web or textile material through a bath containing the anhydride based graft copolymer and then through squeeze rolls.

In a preferred embodiment of the invention, the hydrophilic finish is applied to the textile material during the dyeing process in which a dispersed dye solution is exhausted onto the textile material. The temperature is then raised to a temperature above the glass transition temperature (Tg) of the textile material, usually above for 180° C. for polyester, preferably above 200° C. The dye and anhydride based graft copolymer migrate to the interior of the swollen fiber and, on cooling, the dye and anhydride based graft copolymer are trapped in the textile matrix. Other methods of textile finishing will be familiar to those skilled in the art.

The concentration of anhydride based graft copolymer in the web is from about 0.1 to about 20 weight percent after final drying of the textile material prepared from the web. Preferably, the concentration of anhydride based graft copolymer in the textile material is from about 1 to about 10 weight percent, more preferably 2 to 5 weight percent, after final drying of the textile material.

Textiles materials prepared with the anhydride based graft copolymer of the present invention may be coated. Such coatings and their method of application are well known in the art.

The anhydride based graft copolymers of the invention provide a durable hydrophilic finish to textile materials, preferably textile materials prepared from polyester and blends of polyester. Such hydrophilic finish eliminates the shortcomings inherent in polyester such as polyester's natural affinity for oils and oil borne stains, polyester's tendency to collect soil during laundering, static cling problems inherent in polyester, and wearer discomfort resulting from the hydrophobicity of polyester.

The following nonlimiting examples illustrate further aspects of the invention.

EXAMPLE 1

Preparation of Styrene-Maleic Anhydride Graft Copolymer Using Solvent.

Styrene-maleic anhydride resin (SMA 1000 from Elf Atochem), 15 grams, was slurried in an amine terminated poly(oxypropylene-b-oxyethylene) copolymer (JEFFAMINE XTJ 505 from Huntsman). The reaction mixture was heated to 90° C. and the temperature was maintained for a period of 6 hours. The reaction product was a viscous yellow oil which was cooled. The product was dissolved in 100 grams of 2-propanol which formed an amber colored liquid.

EXAMPLE 2

Preparation of Styrene-Maleic Anhydride Graft Copolymer Using Solvent.

Styrene-maleic anhydride resin (SMA 1000 from Elf Atochem), 20 grams, was slurried in 39.6 grams of ethoxy polyethylene glycol (CARBOWAX 550 from Union Carbide), 13.5 grams of NEODOL 25-9 and 26.1 grams of NEODOL 25-7 from Shell Chemical. The reaction mixture was heated to 110° C. for 2 hours and the temperature was raised to 140° C. for 3 hours. The reaction product was a clear yellow oil solution which was cooled. Water, 226.1 grams was added. The pH of the solution was then adjusted to between 6 and 7 using about 2 mls of 50% NaOH solution. The final solids of the reaction product was approximately 30 percent.

EXAMPLE 3

Preparation of Styrene-Maleic Anhydride Graft Copolymer Using Solvent.

Styrene-maleic anhydride resin (SMA 1000 from Elf Atochem), 20 grams, was slurried in 29.7 grams of ethoxy polyethylene glycol (CARBOWAX 550 from Union Carbide), 10.1 grams of NEODOL 25-9 and 19.8 grams of NEODOL 25-7 from Shell Chemical. The reaction mixture was heated to 160° C. and held at that temperature for a period of 6 hours. The reaction product was a clear viscous yellow oil solution which was cooled and diluted with 185.7 grams of water. The pH of the solution was adjusted to between 6 and 7 using about 2 mls of 50% NaOH solution. The final solids of the reaction product was determined to be approximately 30 percent.

EXAMPLE 4

Preparation of Styrene-Maleic Anhydride Graft Copolymer Using Solvent.

Styrene-maleic anhydride resin (SMA 1000 from Elf Atochem), 20 grams was slurried in 19.7 grams of ethoxy polyethylene glycol (CARBOWAX 550 from Union Carbide), 13.5 grams of NEODOL 25-9 and 26.4 grams of NEODOL 25-7 from Shell Chemical. The reaction mixture was heated to 160° C. and held at that temperature for a period of 6 hours. The reaction product was a clear yellow oil solution which was cooled and diluted with 185.7 grams of water. The pH of the solution was then adjusted to between 6 and 7 using about 2 mis of 50% NaOH solution. The final solids of the reaction product was determined to be approximately 30 percent.

EXAMPLE 5

Solventless Method for Preparing Styrene-Maleic Anhydride Graft Copolymer.

Styrene, 30.9 grams, and 29.1 grams of maleic anhydride was stirred with 216.0 grams of CARBOWAX methoxy polyethylene glycol 550 (from Union Carbide), 8.2 grams of NEODOL 25-9 and 15.8 grams of NEODOL 25-7 (both obtained from Shell Chemical) which formed a homogeneous clear/colorless mixture. The mixture was heated to 50° C. and 1.2 grams of lauroyl peroxide and 1.2 grams of dicumyl peroxide were added while a nitrogen blanket was introduced. The reaction temperature was increased to 116.5° C. over a 2 hour period of time. It was observed that at 74° C. the mixture became pale yellow, hazy/milky in appearance. It was observed that at 92° C. the mixture became peach colored, hazy/milky in appearance. The reaction temperature was increased to 152° C. over a 1 hour period of time and held at that temperature for 30 minutes wherein the mixture appeared rose colored and clear. The reaction product was cooled.

The reaction product was diluted to 30% "activity" with tap water to form a solution. As used herein, "activity" is the neat polymeric product obtained from the in situ polymerization/esterification. The pH of the solution was adjusted from 2.7 to 6.3 using 10.8 grams of a 50% solution of NaOH. The solution was pink and clear which changed to a golden yellow color after 2 days.

EXAMPLE 6

Solventless Method for Preparing Styrene-Maleic Anhydride Graft Copolymer.

Styrene, 30.9 grams, and 29.1 grams of maleic anhydride was stirred with 168.0 grams of CARBOWAX methoxy polyethylene glycol 550 (from Union Carbide), 24.6 grams of NEODOL 25-9 and 47.4 grams of NEODOL 25-7 (both obtained from Shell Chemical) which formed a homogeneous clear/colorless mixture. The mixture was heated to 50° C. and 1.2 grams of lauroyl peroxide and 1.2 grams of dicumyl peroxide were added while a nitrogen blanket was introduced. The reaction temperature was increased to 125° C. over a 2 hour period of time. It was observed that at 63° C. the mixture became pale yellow, hazy in appearance, at 93° C. the mixture became orange/yellow in appearance, at 105° C. the mixture became yellow, almost clear, at 110° C. the mixture became orange and clear. The reaction temperature was increased to 148° C. over a 1 hour period of time and held at that temperature for 45 minutes. It was observed that at 146° C. the mixture became rose color and clear. The reaction product was cooled.

The reaction product was diluted to 30% "activity" with tap water to form a solution. As used herein, "activity" is the neat polymeric product obtained from the in situ polymerization/esterification. The pH of the solution was adjusted from 2.7 to 6.5 using 11.1 grams of a 50% solution of NaOH. The solution was pink and clear which changed to a golden yellow color after 2 days.

EXAMPLE 7

Solventless Method for Preparing Styrene-Maleic Anhydride Graft Copolymer.

Styrene, 30.9 grams, and 29.1 grams of maleic anhydride was stirred with 120 grams of CARBOWAX methoxy polyethylene glycol 550 (from Union Carbide), 41 grams of NEODOL 25-9 and 79 grams of NEODOL 25-7 (both obtained from Shell Chemical) which formed a homogeneous clear/colorless mixture. The mixture was heated to 50° C. and 0.3 grams of lauroyl peroxide and 0.3 grams of dicumyl peroxide were added while a nitrogen blanket was introduced. The reaction temperature was increased to 110° C. over a 2 hour period of time. It was observed that at 63° C. the mixture became pale yellow and clear, in appearance, at 68.5° C. the mixture became pale yellow and hazy in appearance, at 95° C. the mixture became yellow, almost clear, at 103° C. the mixture became yellow and clear. The reaction temperature was increased to 152° C. over a 1 hour period of time and held at that temperature for 130 minutes. It was observed that at 142° C. the mixture became light pink and clear. The reaction product was cooled.

The reaction product was diluted to 30% "activity" with tap water to form a solution. As used herein, "activity" is the neat polymeric product obtained from the in situ polymerization/esterification. The pH of the solution was adjusted from 2.7 to 6.8 using 11 grams of a 50% solution of NaOH. The solution was pink and clear which changed to a golden yellow color after 2 days.

EXAMPLE 8

The anhydride based graft copolymers prepared with a solvent in Examples 2–4 were applied as a hydrophilic finish to a polyester fabric as follows: 100 grams of a 10% copolymer solution was added to a TERG-O-TOMETER pot and a 4×6" swatch of prewashed polyester was stirred in it for a period of 15 minutes. The swatches were air dried and then heated in a 260° C. oven for 1 minute. The swatches were rinsed for 5 minutes and then dried in a dryer. The hydrophilicity of the swatches was tested by dropping 0.15 ml of a dilute dye solution onto the polyester fabric. The test results are summarized in Table I.

TABLE I

| Copolymer | Result |
|---|---|
| Control (No Polymer) | |
| Example 2 | Dye solution wicked evenly and to a far greater extent than Control. |
| Example 3 | Dye solution wicked evenly and to a far greater extent than Control. |
| Example 4 | Dye solution wicked evenly and to a far greater extent than Control. |

The test results in Table I clearly show that the anhydride based graft copolymers of the invention provide soil release properties to polyester fabric. The data also indicates that the polyester swatches treated with the anhydride based graft copolymers wick to a far greater extent than the control swatch which was treated with water alone. The present inventors believe that the anhydride based graft copolymers of the invention become trapped in the matrix of the polyester fabric and provide the polyester fabric with a hydrophilic finish which significantly increases the water absorbency of the polyester fabric and makes the polyester fabric easier to clean.

EXAMPLE 9

The anhydride based graft copolymers prepared without a solvent in Examples 5–7 were applied as a hydrophilic finish to a polyester fabric as follows: 250 grams of a 4% copolymer solution was added to a TERG-O-TOMETER pot and a 4×6" swatch of prewashed polyester was stirred in it for a period of 15 minutes. The swatches were air dried and then heated in a 205° C. oven for 1 minute. The swatches were rinsed for 5 minutes and then dried in a dryer. The hydrophilicity of the swatches was tested by dropping 0.15 ml of a dilute dye solution onto the polyester fabric. The test results are summarized in Table II.

TABLE II

| Copolymer | Result |
|---|---|
| Control (No Polymer) | |
| Example 5 | Dye solution wicked evenly and to a far greater extent than Control. |
| Example 6 | Dye solution wicked evenly and to a far greater extent than Control. |
| Example 7 | Dye solution wicked evenly and to a far greater extent than Control. |

The test results in Table II clearly show that the anhydride based graft copolymers of the invention provide soil release properties to polyester fabric. The data also indicates that the polyester swatches treated with the anhydride based graft copolymers wick to a far greater extent than the control swatch which was treated with water alone. The present inventors believe that the anhydride based graft copolymers of the invention become trapped in the matrix of the polyester fabric and provide the polyester fabric with a hydrophilic finish which significantly increases the water absorbency of the polyester fabric and makes the polyester fabric easier to clean.

EXAMPLE 10

The anhydride based graft copolymers prepared by the two-step process utilizing solvent in Examples 2–4 and the anhydride based graft copolymers prepared by the in situ solvent-free process in Examples 5–7 were evaluated for film forming properties.

A 30% polymer solution in water was prepared for each copolymer. Two grams of each solution was placed in an aluminum pan having a 2 inch diameter. The aluminum pan was placed in an oven having a temperature of 140° C. for two hours to allow the water to evaporate. The test results are summarized in Table III.

TABLE III

Results of Film Forming Evaluations

| Polymer | Film properties |
|---|---|
| Example 2 | clear waxy film |
| Example 3 | clear waxy film |
| Example 4 | clear waxy film |
| Example 6 | clear waxy film |
| Example 7 | clear waxy film |
| Example 8 | clear waxy film |

The test results in Table III clearly show that the anhydride based graft copolymers of the invention form a waxy film which adheres to textiles. The anhydride based graft copolymers of the invention provide a durable hydrophilic finish on articles prepared from polyester or blends of polyester. Such hydrophilic finish eliminates the shortcomings inherent in polyester such as it high affinity for oils, staining during washing, static cling problems, and wearer discomfort.

While the invention has been described with particular reference to certain embodiments thereof, it will be understood that changes and modifications may be made by those of ordinary skill in the art within the scope and spirit of the following claims.

What is claimed is:

1. An improved textile material having a hydrophilic finish which is made by a method comprising (I) applying to a fibrous web an aqueous solution comprising an anhydride based graft copolymer, wherein said anhydride based graft copolymer comprises the reaction product of an ethylenically unsaturated monomer, an anhydride monomer selected from the group consisting of maleic anhydride, itaconic anhydride, and mixtures thereof, either a monofunctional polyglycol having a hydroxyl or amine terminal group or a polyfunctional polyglycol having a weight average molecular weight of greater than 5,000 and at least one terminal hydroxyl group, and a free radical initiator; and (II) drying the fibrous web at a temperature sufficient to remove substantially all the water from the anhydride based graft copolymer solution, wherein the concentration of anhydride based graft copolymer in the solution is sufficient to provide 0.1 to 20 weight percent of the anhydride based graft copolymer in the web based on the dry weight of the textile material prepared from the web.

2. The textile material according to claim 1 wherein the step of applying to a fibrous web includes impregnating the fibrous web with the solution substantially through its thickness.

3. An improved textile material having a hydrophilic finish which is made by a method comprising (I) applying to a fibrous web an aqueous solution comprising an anhydride based graft copolymer, wherein said anhydride based graft copolymer is prepared by a two-step process comprising reacting an ethylenically unsaturated monomer and an anhydride monomer selected from the group consisting of maleic anhydride, itaconic anhydride, and mixtures thereof, and a free radical initiator, in the presence of a solvent, and isolating the product from the solvent and reacting the product with either a monofunctional polyglycol having a hydroxyl or amine terminal group or a polyfunctional polyglycol having a weight average molecular weight of greater than 5,000 and at least one terminal hydroxyl group, to form an anhydride based graft copolymer; and (II) drying the fibrous web at a temperature sufficient to remove substantially all the water from the anhydride based graft copolymer solution, wherein the concentration of anhydride based graft copolymer in the solution is sufficient to provide 0.1 to 20 weight percent of the anhydride based graft copolymer in the web based on the dry weight of the textile material prepared from the web.

4. The textile material according to claim 3 wherein the step of applying to a fibrous web includes impregnating the fibrous web with the solution substantially through its thickness.

5. The textile material according to claim 1 wherein the fibrous web comprises polyester fibers.

6. The textile material according to claim 1 wherein the fibrous web comprises a blend of polyester fibers and fibers selected from the group consisting of cotton, polyacrylics, polyamides, polyolefins, rayons, wool, and combinations thereof.

7. The textile material according to claim 1 wherein the anhydride based graft copolymer is present in the web in an amount of from about 1 to about 10 weight percent, based on the dry weight of textile material.

* * * * *